United States Patent [19]

Anders

[11] 4,440,241

[45] Apr. 3, 1984

[54] METHOD AND APPARATUS FOR DRILLING A WELL BORE

[76] Inventor: Edward O. Anders, 1502 Tallulah Ct., Houston, Tex. 77077

[21] Appl. No.: 294,497

[22] Filed: Aug. 24, 1981

Related U.S. Application Data

[63] Continuation-in-part of Ser. No. 19,175, Mar. 9, 1979, abandoned.

[51] Int. Cl.[3] ..... E21B 7/04; E21B 7/08

[52] U.S. Cl. ..... 175/61; 175/76; 175/321; 175/325

[58] Field of Search ..... 175/61, 62, 321, 325, 175/45, 76

[56] References Cited

U.S. PATENT DOCUMENTS

| | | | |
|---|---|---|---|
| 2,829,864 | 4/1958 | Knapp | 175/61 X |
| 2,901,221 | 8/1959 | Whittle | 175/321 X |
| 3,042,125 | 7/1962 | Duncan | 175/61 X |
| 3,088,532 | 5/1963 | Kellner | 175/321 X |
| 3,593,810 | 7/1971 | Fields | 175/61 |
| 3,635,036 | 1/1972 | Hooper, Jr. | 175/61 X |
| 3,878,903 | 4/1975 | Cherrington, Jr. | 175/61 X |
| 3,997,008 | 12/1976 | Kellner | 175/61 X |
| 4,015,673 | 4/1977 | Craig, Jr. et al. | 175/61 |
| 4,022,279 | 5/1977 | Driver | 175/61 X |

*Primary Examiner*—Stephen J. Novosad

*Attorney, Agent, or Firm*—Vaden, Eickenroht, Thompson, Bednar & Jamison

[57] ABSTRACT

A method of and apparatus for drilling directional well bores is disclosed in which the well bore or a portion thereof is drilled along a line that follows, as close as possible, a preselected catenary curve. An extensible joint located between a stabilizer just above the drilling bit and a stabilizer spaced from the bit stabilizer is used to cause the bit to tend to increase the dip angle of the well bore at an increasing rate.

13 Claims, 6 Drawing Figures

METHOD AND APPARATUS FOR DRILLING A WELL BORE

This is a continuation-in-part of application Ser. No. 19,175, filed Mar. 9, 1979, and entitled "Drilling Method and Apparatus", now abandoned.

This invention relates to well drilling generally. In one of its aspects, it relates to a method of and apparatus for drilling a directional well, or a portion thereof, along a preselected path from the surface to a preselected point that is displaced horizontally from a vertical line extending through the starting point on the surface. It is another aspect of this invention to provide a method of and apparatus for urging the drill bit to tend to drill a well bore that has an increasing rate of change of angle to the vertical.

Many oil and gas wells, and most of those drilled offshore, are drilled at an angle to the vertical to locate the bottom of the well bore at some point displaced horizontally from a line extending vertically into the earth below the drilling rig. The coordinates of the final depth point of the well bore are selected prior to the well being drilled. These coordinates will include the vertical depth of the final depth point, the horizontal displacement, and the compass direction or bearing of this point from the drilling rig. The most common technique used by directional drillers to drill such wells is to gradually increase the dip angle, i.e., the angle between a vertical line and the longitudinal axis of the well bore, until the longitudinal axis of the well bore is pointing at the preselected final depth point, then drill the hole straight at the target—the final depth point. Usually, when the dip angle of a well bore is changed, it is done at a constant rate, which results in the well bore following a radius of curvature.

The drilling assembly or drill string for drilling a well bore includes the drill bit at the bottom of the drill string, a plurality of drill collars directly above the bit, and the drill pipe that extends from the drill collars to the surface. A drill collar is a thick-walled tubular member and a sufficient number of such collars are placed in the drill collar section to provide the desired weight on the bit. Preferably, the drill pipe is in tension during the drilling operations. Also, preferably, the neutral point, that is the point in the string where the stress changes from tension to compression, is located below the top of the drill collars.

The most common problem encountered while drilling a well bore is the sticking of the drill string somewhere along the well bore. This can occur well above the bottom of the hole. For example, where the hole is curved along a radius of curvature, the upward force required to support the pipe string can pull the pipe into the upper side of the curved portion of the hole to the extent that the frictional force between the pipe and the wall of the well bore is such that the pipe cannot be moved. The places in a well bore where this type of sticking is likely to occur are referred to as "key seats".

Usually, however, when a pipe string sticks in a well bore, it involves the drill collars and in most cases is the result of what is known as "differential pressure sticking". This occurs when the drill collars are laying against a porous formation that contains a fluid at a lower pressure than the hydrostatic pressure of the drilling fluid in the well bore. This creates a differential pressure equal to the difference between the formation pressure and the hydrostatic pressure of the drilling fluid that acts across the area of the drill collars in engagement with the formation. The large normal force thus created will produce a frictional force between the drill collars and the well bore that will require a substantial tensile force to overcome. In a conventional, directionally drilled well bore, when the drill collars are stuck against the well bore by differential pressure, the large upward force on the drill pipe required to free the pipe causes the drill pipe to move into frictional engagement with the high side of the well bore, which increases the frictional drag of the pipe against the well bore and the total force required to free the pipe. In other words, in such situations the harder the pull the higher the frictional forces to be overcome, with the result that pulling on the pipe is self defeating.

The primary object of this invention is to provide a method of drilling a well bore that substantially reduces the likelihood of the drill string becoming stuck because of a key seat in the well bore and that reduces the frictional force between the drill string and the well bore when a section of the drill string is held against the wall on the well bore by differential pressure so that most of the upward force applied to the drill string will be available to pull the stuck section away from the wall.

In accordance with my invention, the drill string is treated like a portion of a chain or other flexible line of uniform weight per unit of length, which, when suspended at both ends, assumes a "catenary" curve. Thus, I propose to drill a well bore along the path of a catenary curve based on a preselected horizontal component of the total force required to support the drill string, if it extended the full length of the catenary. Consequently, if the pipe becomes stuck in the well bore, and upward pull sufficient to produce the preselected horizontal component may be applied to the pipe to cause the pipe to tend to assume the same catenary curve as that of the well bore. This will cause the pipe string to tend to move to the center of the well bore away from its wall. So positioned, the upward pull of the pipe and/or the upward and downward shock of jars will be transmitted substantially undiminished to the portion of the pipe string that is stuck, greatly increasing the chances of freeing the pipe string.

A further advantage of drilling a well bore along a preselected catenary curve is that, as the drilling progresses, an increasing portion of the upper end of the drill string will have sufficient tension therein to tend to move away from the wall of the well bore, thereby decreasing the frictional forces between the drill string and the wall of the well bore that resist movement of the drill string in the well bore ahd reduce the wear on the casing in the upper end of the well bore by the rotating drill string.

The use of the two stabilizers is a known technique for causing a drilling bit to increase the dip angle of a well bore. One stabilizer is located just above the bit and the other is located some distance above the bit stabilizer. The drill collars between the two stabilizers, being at an angle to the vertical, will tend to bend in the vertical plane due to their own weight. The weight of the drill collars above the upper stabilizer acting on the bent section of collars between the stabilizers cause it to bend more. The bit stabilizer will pivot, due to the bending of the collars between the stabilizers and rotate the bit face toward the horizontal causing it to tend to "build angle".

The rate that the angle of the well bore actually increases is a function of many variables such as weight on the bit, hole angle, and the distance between the stabilizers. The dip of the formation being penetrated also affects the rate of change of the dip angle of the well bore. But for a given down hole assembly and weight on the bit, the bit will tend to build angle at a fairly constant rate.

This is fine for building angle along a radius of curvature. To approximate a catenary curve, however, as in my method, it is preferable to build angle at an increasing rate, and it is an object of this invention to provide apparatus for and a method of accomplishing this. This object is accomplished in accordance with my invention, by increasing the distance between the stabilizers, as the bit drills a section of the well bore. This increases the deflection of the collars and the angle the bit face makes with the vertical, as the bit moves away from the upper stabilizer.

It is yet another feature of this invention to provide an improved method and apparatus that is especially useful in drilling sub-surface boreholes in a substantially horizontal direction.

It is another feature of this invention to provide apparatus that can exert a force on a drill bit causing it to drill ahead along any dip angle.

These and other features and advantages of this invention will become apparent to those skilled in the art from the following detailed description wherein reference is made to the figures in the accompanying drawings.

DETAILED DESCRIPTION

Figure 1:
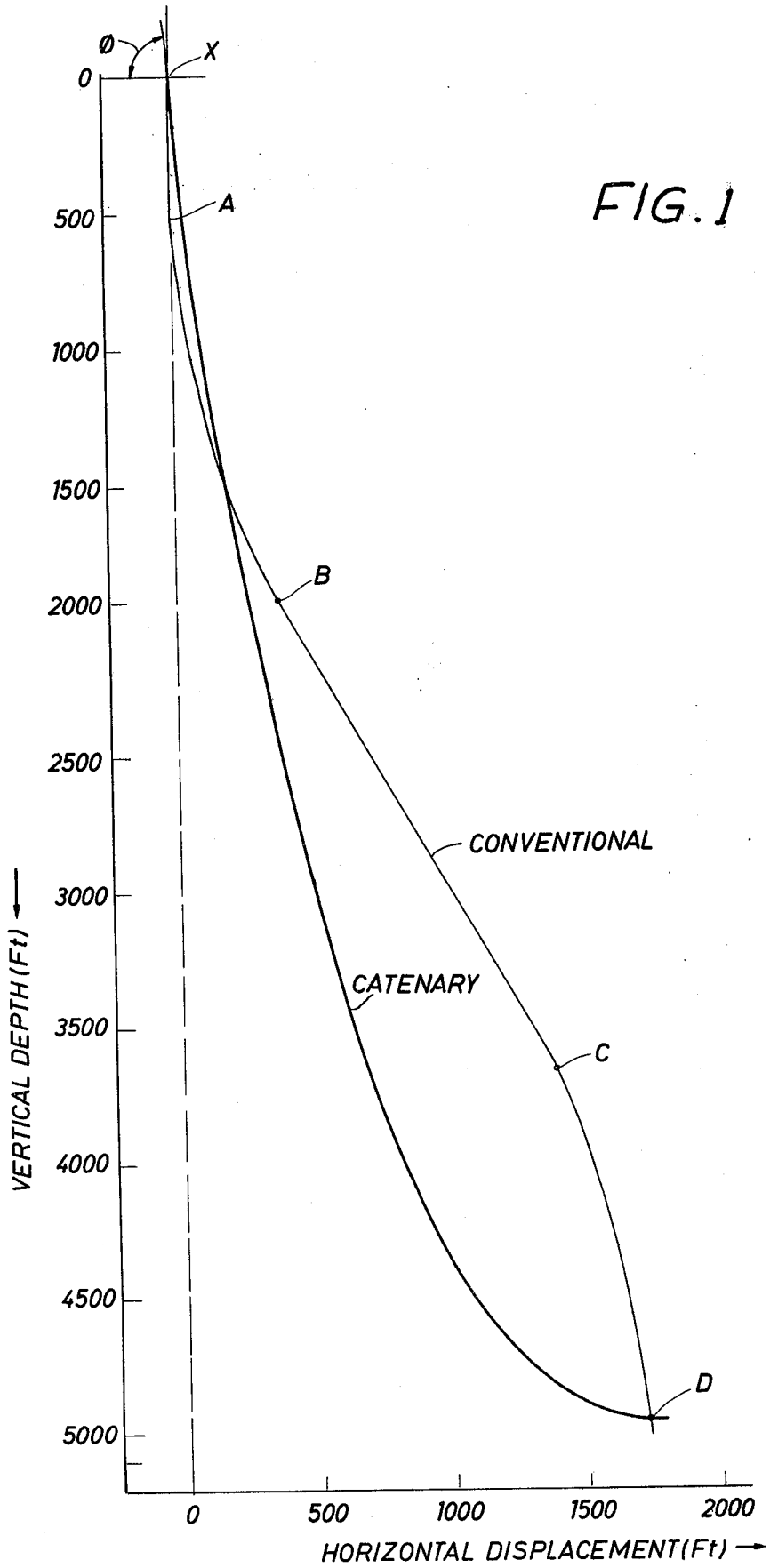
FIG. 1 shows the path of a well bore that was drilled using the radius of curvature technique to change dip angle and one that was drilled along a catenary curve in accordance with the present invention.

FIG. 1 shows a typical path followed by a conventional directional well and the path a well may take when drilled in accordance with the concepts of the present invention. In either case, the object is to drill from point X on the surface to point D, which is approximately 1,700 feet horizontally displaced from point X and some 5,000 feet below the surface.

After having completed the drilling of the catenary well of FIG. 1, and assuming that the subsurface formation of interest resides at point D, then the well may be completed at that point. The dip angle of this well at point D is approximately 90° and, if the prospective producing formation extends in a horizontal direction, it may be desirable to increase the area of the formation penetrated by the well bore by continuing to drill in a horizontal direction.

When a well is drilled along the path indicated as "conventional" in FIG. 1, the portion of the well bore between points A and B and between C and D are drilled with constantly changing dip angles along a radius of curvature. The portions of the well bore between X and A and between B and C are drilled with a constant dip angle. The result is that even during normal drilling operations, the pipe will lay against the low side of the well bore between points B and D and will tend to be pulled into the upper side of the well bore between points A and B. Should the pipe become stuck sometime during the drilling of the portion between C and D, an upward force on the pipe, in an attempt to free the pipe, will pull the pipe into the upper side of the well bore in the section A to B, which is the keyseat problem described above, and will pull the pipe into the low side of the well bore in the curved section around point C causing another keyseat situation. Thus, the upward pull on the pipe not only has to provide sufficient force to pull the pipe away from wherever it's stuck, probably by differential pressure sticking, but it also has to overcome the frictional force created by the pipe being pulled into the side of the hole at the keyseats between points A and B and around point C.

In accordance with this invention, a well bore drilled to the same final depth point in FIG. 1 along a catenary curve, such as the catenary curve shown in FIG. 1, will greatly reduce these problems. The catenary curve shown in FIG. 1 is idealistic in that it is a catenary curve all the way from point X to point D. In actual practice, for a number of reasons, it is impractical to begin a hole with a dip angle, which would be necessary if the hole was to follow a catenary all the way. Therefore, in the actual practice of this invention, it is generally accepted that the hole will be drilled straight for a short distance below the surface, which distance should be as short as possible. As stated above, preferably, the well bore is started at the angle that the selected catenary curve makes with the vertical at the surface. This can be done with a "slant hole" drilling rig, and when such a rig is available, it should be employed in the practice of this invention.

Figure 5:
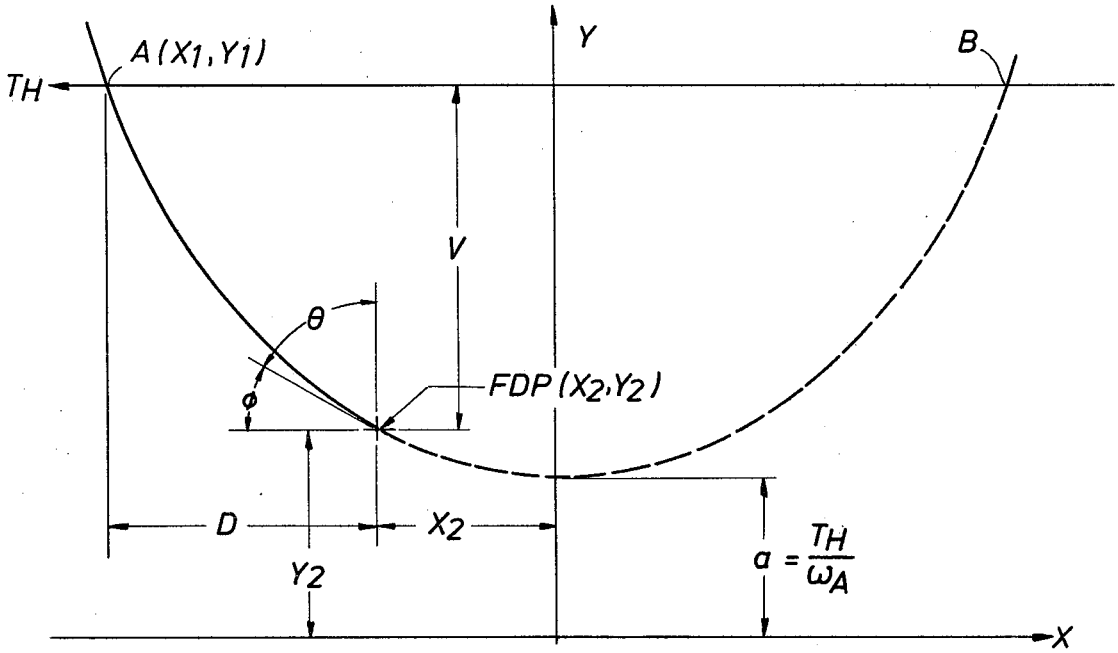
FIG. 5 is a graphical representation of a catenary, a portion of which is to be the path of a well bore.

Referring to FIG. 5, a catenary curve is shown extending between points A and B. This is the curve that would be assumed by a flexible line of uniform weight if it was suspended between these two points. In planning the drilling program for a well bore that will follow a catenary curve, horizontal displacement D of the final depth point (FDP) of the well bore relative to point A on the surface where the drilling is to begin will be known as will the total vertical depth V. In addition, the operator will generally specify the maximum dip angle that he wants for the well bore when it reaches the final depth point. This is angle $\theta$ in FIG. 5. There are a large number of catenary curves that can extend between point A and pass through the final depth point, and each one will have a different dip angle when it passes through the final depth point.

Therefore, the next step is to determine which curve is best suited for the given conditions. The equation for any catenary curve is:

$$y = a/2\,[e^{x/a} + e^{-x/a}]$$

where a is the value of y, where x=0.

The first step is the selection of the horizontal component of the total force required to support the string as a catenary, which is designated $T_h$.

This figure should be one that is realistic, i.e., it should be the horizontal component of a total force that can be exerted by the drilling rig being used. For example, as $T_h$ increases for a given flexible line weighing $W_a$, pounds per foot, which requires a given vertical component to support it, then the angle the catenary makes with the vertical at the surface increases and the total force, $T_t$, can become quite large.

Once the horizontal component is assumed, then the value of "a" can be calculated, since for any catenary:

$$a = \frac{T_h}{W_a}$$

where $W_a$ is the weight of the pipe per foot in air less the bouyant effect of the drilling mud in which the pipe is submerged.

Initially then, certain values will be known, such as the weight per foot of the drill pipe that will be used, and the density of the drilling mud in pounds per gallon.

Point A on the curve is located at the surface and has coordinates $(x_1,y_1)$. The final depth point has the coordinates $(x_2,y_2)$.

Since $y_2=y_1-V$, the vertical depth, two equations can be set up as follows:

$$y_2 = \frac{a}{2}\left[e^{\left(\frac{D+x2}{a}\right)} + e^{-\left(\frac{D+x2}{a}\right)}\right] - V, \text{ and}$$

$$y_2 = \frac{a}{2}\left[e^{\frac{x2}{a}} + e^{-\frac{x2}{a}}\right]$$

A value for $x_2$ is assumed and both the equations are solved for $y_2$. If $y_2$ from the first equation does not equal $y_2$ from the second equation, then $x_2$ is changed an incremental amount 1, 10, or 100, or the like, and the process repeated until a value for $x_2$ is found that solves both equations. When this occurs, the equation for the catenary produced by the assumed horizontal component, $T_h$, has been determined. Now the slope of the curve at the final depth point can be calculated using the first derivative of the equation for the catenary, which is as follows:

$$\frac{dx}{dy} = \frac{a}{2}\left[e^{\frac{x}{a}} - e^{-\frac{x}{a}}\right]$$

If the dip angle $\theta$, which is the complement of the slope of the curve, $\phi$, at the final depth point, is equal to or less than the maximum desired then this catenary curve can be the basis for the drilling program. If it is not, then another value for the horizontal component is assumed and the process repeated.

For an example of how this invention would be applied to a real situation, assume that the operator wants to drill a well to a final depth point that is horizontally displaced 4,000 feet with a total vertical depth of approx. 17,500 feet. Assume also that circumstances require that the first 135 feet of hole must be vertical after which dip angle can be built to the required starting angle of the catenary curve at a constant rate.

As explained above, in order to obtain a true catenary curve from the surface to the final depth point, the hole at the surface will have a slight angle from the vertical. In most cases, however, it is not possible to obtain the starting angle desired, and therefore it is necessary to drill a section of vertical hole and then build the angle, using the radius of curvature method, until you reach the starting angle of the catenary.

From the known information, such as weight of the pipe and density of the drilling mud, a horizontal component for the total force required to support the catenary was assumed to be 27,500 pounds. This produced a catenary having a dip angle at the final depth point of 32.87° and a total force, $T_t$, of 255,057 pounds to support the catenary. Assume that the operator has specified that he does not want a dip angle in excess of about 20° at final depth point, then the catenary produced by the assumed horizontal component was not satisfactory. This catenary also had an initial angle of 6.45°.

To reduce the angle at the final depth point, the horizontal component must be increased to increase the length of the catenary. A horizontal component of 52,000 lbs was assumed and the calculation repeated. The dip angle of the hole at the final depth point was reduced to 20.52°, which was acceptable. The starting angle of the curve was 8.1936° and the total force required to produce the $T_h$ was 349,488 pounds.

To drill the well, the first 135 feet would be drilled vertically after which dip angle would be built until the hole has a dip angle of 8.1936° and a measured depth of 954 feet, a vertical depth of 951 feet, and a horizontal displacement of 58.5 feet. From there, the drilling program would follow the catenary curve produced by the assumed horizontal component of 52,000 pounds.

Returning to the ideal situation where the catenary curve is followed from the surface all the way to the final depth point, one of the great advantages of this invention can be illustrated with the catenary produced under the above conditions for an assumed horizontal tension component of 27,500 lbs. This figure requires a starting angle for the catenary of only 6.12°, but as stated above, had a final depth point dip angle of 32.46°. If such a hole could be started at the surface with the 6.12° angle and drilled along the catenary until it reaches the final depth point, the hole would be displaced horizontally 4,000 feet. Its measured length would be 18,089 feet and the vertical depth would be 17,521 feet. The actual weight of the pipe at this depth is 203,831 lbs. If we assume an additional tensile force contributed by the drill collars, while drilling with 12,000 lbs weight on the bit, to be 8,654 lbs, the total actual tension at the surface will be 212,495 lbs. With this catenary, a total axial tensile force of 255,057 lbs is required to suspend the pipe in the well bore—i.e., for the pipe to assume the catenary curve along which the hole has been drilled. Then the 212,495 lbs at the surface represents 83% of that required to totally suspend the drill pipe, which results in casing wear, which is proportional to the normal force exerted by the tool joints, being reduced by 83%. This would also result in the same reduction in the force required to rotate the pipe, while drilling.

The above is based on the conditions existing as the well approaches the final depth point, but considerable savings would be realized at the points well above the final depth point. For example, when the well bore has reached a total vertical depth of 12,382 feet with a measured depth of 12,553 feet and a horizontal displacement of 2,000 feet, the tensile load at the surface is 144,446 lbs. This is 56.5% of the total load required to suspend the pipe in the well bore and is a substantial reduction in the normal force between the rotating drill pipe and the wall of the well bore and any casing in the well bore.

Figure 2:
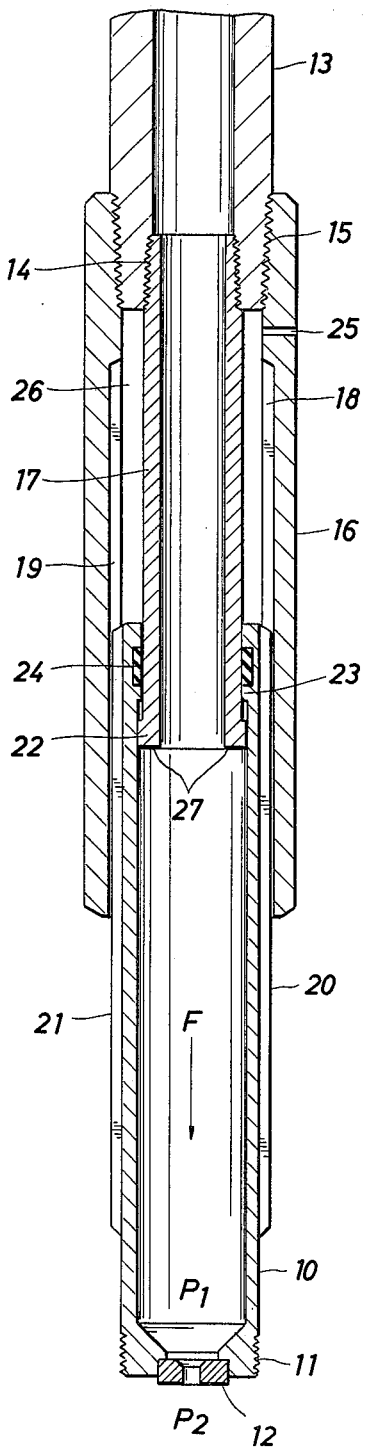
FIG. 2 is a vertical cross section of a tool for increasing the distance between stabilizers to obtain an increasing rate of change of dip angle and for driving a drill bit once the borehole has departed from vertical to an extent that drill collars no longer provide a driving force.

As the dip angle of the well bore approaches and then continues in a horizontal direction, the ability of the drill collars to exert their weight on the bit decreases to zero. Therefore, in accordance with one aspect of this invention, means are provided to exert a force on the bit sufficient for it to continue drilling in a horizontal or near horizontal direction. One embodiment of such means is shown in FIG. 2.

The assembly shown includes male spline member 10 having threaded section 11 for connecting the assembly to the drill bit (not shown). Orifice 12 is located in the lower end of the spline member through which drilling mud flows from the spline member to the bit.

Section 13 of the drill pipe includes inner threads 14 and outer threads 15. Female spline member 16 is connected to outer threads 15 of the drill pipe. Wash pipe 17 is located inside female spline member 16 and is connected to inner threads 14. Drilling mud, pumped down the drill string from the surface, flows through wash pipe 17 and male spline member 10 to orifice 12.

Female spline member 16 has on its inner surface a plurality of guide slots 18 and 19, which cooperate with a corresponding plurality of ribs 20 and 21 on the outside of male spline 10. Such construction allows the two members to move longitudinally relative to each other, but prevents relative rotation so that torque can be transmitted through the assembly to the bit. Shoulders 22 and 23 on wash pipe 17 and male spline member 10, respectively, limit the distance male spline member 10 can extend outwardly from female member 16.

Seal 24 on male spline member 10 confines the drilling mud to the wash pipe and the male spline member.

In operation, orifice 12 produces a pressure drop in the drilling mud as it flows through the orifice. The pressure difference between upstream pressure $P_1$ and downstream pressure $P_2$ acts on an effective area equal to an area having the outside diameter of the wash pipe. This unbalanced hydraulic force, F, is transmitted to the bit and provides the necessary force on the bit for it to drill through the earth in a horizontal direction.

It is another feature and aspect of this invention to provide a method of and apparatus for drilling a well bore that will tend to increase the dip angle of the well bore. As explained above, directional drillers have in the past used the stabilizer method to build hole angle. They do this by locating one stabilizer, the bit stabilizer, just above the bit and another stabilizer, the string stabilizer, spaced above the bit stabilizer a preselected distance. The drill collar section between the stabilizers will tend to bend toward the low side of the hole due to its own weight. With the addition of the weight of the drill collars above the upper stabilizer, the section between the two stabilizers will bend even more toward the low side of the hole.

Figure 6:
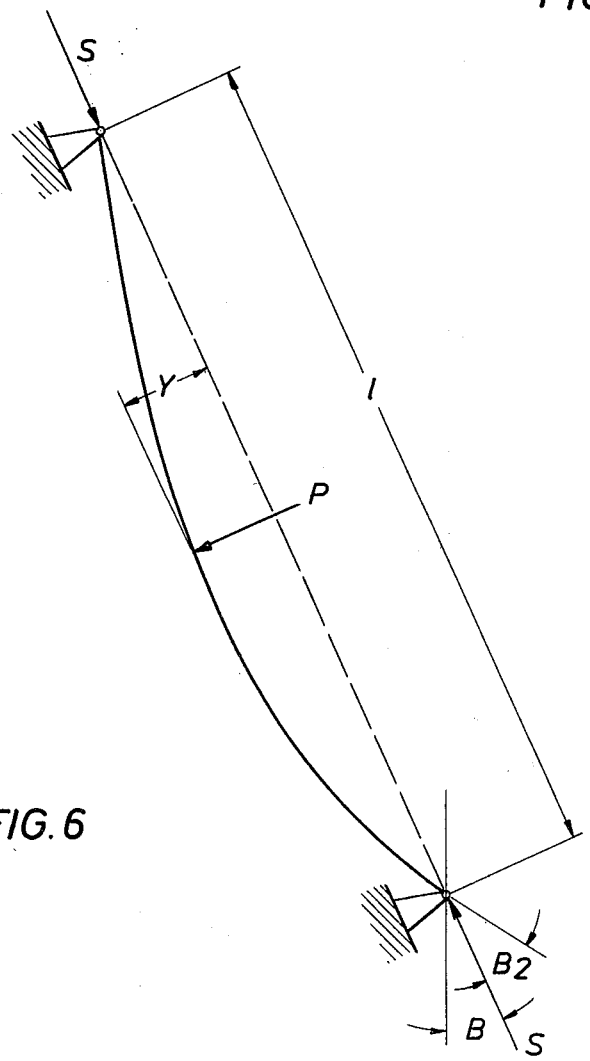
FIG. 6 is a free body diagram of a section of drill collars between spaced stabilizers showing the forces acting on the drill collar section in an inclined borehole.

A free body diagram of the forces acting on the section of drill collars between the stabilizers is shown in FIG. 6. In the free body, the ends of the section are treated as being free to rotate around their supports--i.e., the stabilizers. This is true of the bit stabilizer, but is not quite true of the string stabilizer because there will be a resisting moment from the drill collar section above the string stabilizer. The effect of this resisting moment is not deemed to be significant. Therefore, it is neglected in the equations for calculating the total deflection, y, and the angle B2 at which the bit will tend to drill relative to the longitudinal axis of the well bore.

Deflection y is determined by the following equation:

$$y = \frac{5}{384}\,\frac{ql^4}{EI}\left[\frac{\dfrac{l}{\cos u} - l - \dfrac{u^2}{2}}{\dfrac{5}{24}\,u^4}\right]$$

Where:

q=wt. per foot of drill collars x sin B the dip angle of the well bore l=distance between stabilizers $$u = \left[\frac{sl^2}{4EI}\right]^{\frac{1}{2}}$$

Where:

s=wt. of drill collars above upper stabilizer acting along axis of well bore.

E=Modulus of elasticity for the drill collars

I=section modulus

Angle B2 can be calculated using the following equation:

$$\tan^{-1}\frac{dx}{dy} = \left[\frac{ql^3}{2yEI}\right]\left[\frac{\tan u - u}{\frac{1}{3}u^3}\right]$$

When the forces are constant, angle B2 will remain the same and the bit will tend to build an angle at a constant rate, and the well bore will have a constant radius of curvature. By locating the hydraulic assembly shown in FIG. 2 in the section of drill collars between the two stabilizers and using the pressure drop through the hydraulic assembly to provide the same weight on the bit as would be applied by the weight of the collars normally, the bit can drill ahead while the string stabilizer is held stationary. This causes the distance, l, between the stabilizers to increase a distance determined by the stroke of the hydraulic assembly. This will result in a substantially constant increase in angle B2, which will cause the bit to tend to drill a well bore having a constantly increasing dip angle.

For example, assume the following conditions: the drill collars are 6.25 inches O.D. and 2.25 inches I.D. They are operating in mud weighing 12.5 lbs per gallon. The dip angle of the hole where drilling is taking place is 45° and 30,000 lbs is being applied to the section between the stabilizers by the drill collars above the string stabilizer. Assuming an initial distance between the stabilizers of 30 feet, when the hydraulic assembly is completely collapsed, the deflection Y and the angle at the bit B2 for each foot of hole drilled as the hydraulic assembly extends 10 feet would be as follows:

| L | Y | B2 |
|---|---|---|
| 30 | .46 | .2329 |
| 31 | .53 | .2644 |
| 32 | .61 | .2931 |
| 33 | .7 | .2341 |
| 34 | .79 | .3575 |
| 35 | .9 | .3934 |
| 36 | 1.02 | .432 |

-continued

| L | Y | B2 |
|---|---|---|
| 37 | 1.14 | .4734 |
| 38 | 1.29 | .5179 |
| 39 | 1.44 | .5656 |
| 40 | 1.61 | .6166 |

For another example of how this method and apparatus can build angle at an increasing rate, assume a hydraulic assembly having a 20 ft. stroke, 8 inch drill collars having a 3 inch bore, 12.5 lb. mud, located in a well bore with a dip angle of 50°, and 60,000 lbs on the bit. The deflection of the section between the stabilizers will increase from 0.29 inches when the tool is completely collapsed to 2.62 inches when it is fully extended to a distance of 50 feet between the stabilizers. The angle the bit makes with the axis of the well bore will increase from 0.1504°, when the tool is collapsed and the stabilizers are 30 feet apart, to 0.7992° when the tool is fully extended.

By using this method and apparatus for changing the angle the bit makes with the axis of the well bore, it will be much easier for the directional driller to follow a drilling program based upon a catenary curve.

In this respect it should be mentioned that after the catenary curve has been selected, coordinates for points on the cure can be calculated for guiding the directional driller. The points should probably be not less than 50 feet or more than 100 feet, measured either vertically or along the axis of the well bore. The closer the points are together the closer the well bore will approximate the catenary curve, but as a practical matter, even if the hole were drilled between points along a radius of curvature, using the conventional two stabilizer method, the resulting well bore would approximate the catenary sufficiently, that substantially all of the advantages described would be obtained.

Figure 3:
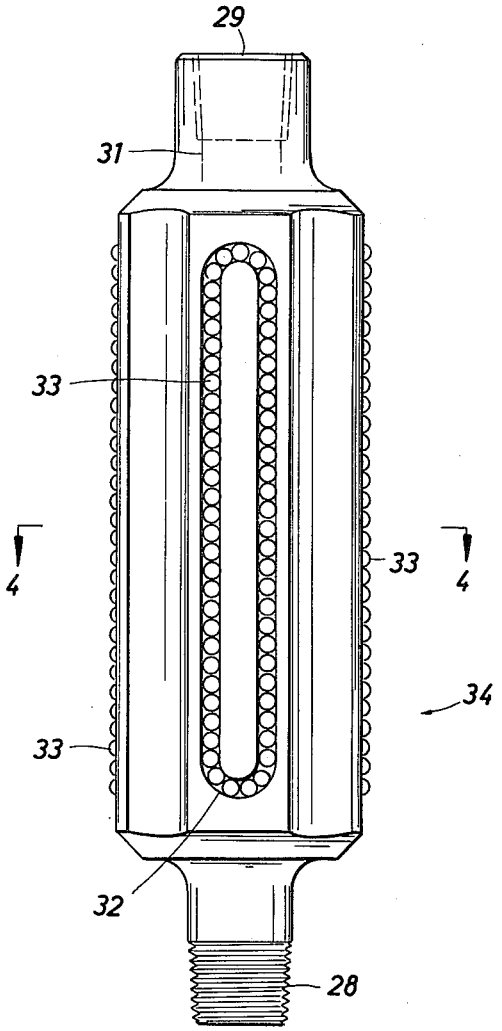
FIG. 3 is a simplified pictorial representation of a combination anti-friction stabilizer useful in the lower portion of a catenary borehole to minimize buckling and drag forces.
Figure 4:
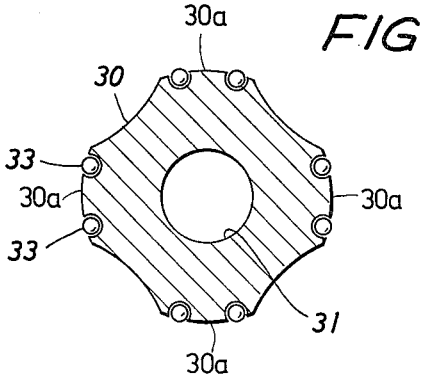
FIG. 4 is a simplified pictorial representation of the tool of FIG. 3 taken along line 4—4 thereof.

In FIGS. 3 and 4, an anti-friction stabilizer is shown, which comprises another feature of the present invention.

The stabilizer, indicated generally by the number 34, comprises tubular body member 30 having four longitudinally extending ribs 30*a* to engage the wall of the well bore. An elongated, oval-shaped groove 32 is cut in each rib.

Body member 30 also includes threaded connections 28 and 29 for connecting the stabilizer in the drill string. A plurality of balls 33, preferably made of an elastomeric material, are located in each groove to engage the wall of the well bore. The balls can roll in the grooves, which reduces the frictional force between the stabilizer and the wall of the well bore.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In a method of drilling a well bore by means of a drill string through which drilling fluid is circulated, the step of causing at least a portion of the well bore from one location beneath the earth's surface to another point therebeneath which other location is displaced both horizontally and vertically with respect to the one location, to approximate the catenary curve that would be assumed by the drill string upon the application of a tension having a preselected horizontal component to thereby cause the drill string to move away from the side of the well bore.

2. In a method of drilling a well bore comprising the steps of predetermining the catenary curve that the drill string would tend to assume when an upward force having a preselected horizontal component is exerted thereon, and drilling the well bore along said predetermined catenary curve so that in the event the lower end of the drill string becomes stuck in the well bore, said upward force on the drill string will cause the drill pipe to tend to assume said predetermined curve which will move at least a substantial portion of the drill string out of engagement with the wall of the well bore to substantially reduce the friction between the wall of the well bore and the drill string and thereby increase the portion of the upward force exerted on the stuck portion of the drill string.

3. In a method of drilling a well bore from a point on the earth's surface to a final depth point below the earth's surface that is displaced horizontally a preselected distance from a vertical line extending through the surface point at a preselected vertical distance below the earth's surface wherein the weight of the bottom hole assembly, the weight of the drill pipe per unit length, the unit weight of the drilling mud, and the maximum desired angle of the well bore from the vertical at the final depth point are known comprising the steps of assuming a horizontal component of the total tensile force that would be exerted at a point at or adjacent the surface by the drill string if the drill string followed a catenary curve that extended from said point through the final depth point, calculating the angle of the catenary curve at said final depth point, raising or lowering the assumed total horizontal component as required to obtain the catenary curve having the desired angle of curvature at the final depth point, and drilling a well bore from said first point to said final depth point along a path that follows substantially the catenary curve that gave the desired angle from the vertical for the well bore at said final depth point.

4. The method of claim 3 in which the well bore is drilled between a plurality of selected points on said catenary curve along a radius of curvature between said points.

5. The method of claim 4 in which the radius of curvature sections are drilled by locating a bit stabilizer adjacent the drill bit and a string stabilizer spaced above the bit stabilizer, placing a predetermined weight on the section of the drill string between the stabilizer to bend the section between the stabilizer to cause the bit to tend to build the angle of the well bore at a predetermined rate.

6. The method of claim 3 in which the well bore is drilled between a plurality of calculated points on said catenary curve by increasing the angle of the well bore between said points at an increasing rate that approximates the change of curvature of said catenary curve.

7. The method of claim 6 in which said sections of the well bore between said points are drilled by locating a bit stabilizer adjacent the bit, locating a string stabilizer in the drill string a preselected distance above the bit stabilizer, locating a telescoping joint in the drill string between the two stabilizers that will allow the length of the drill string between the stabilizer to increase a predetermined distance as the bit deepens the well bore, and causing a pressure drop in the drilling mud flowing through the telescoping joint that will exert a compressive force on the section of the drill string between the telescoping joint and the stabilizer to cause the bit to tend to increase the angle of the well bore as the length of the drill string between the stabilizer increases due to the expansion of the telescoping joint and lowering the drill string to close the telescoping joint each time it reaches the end of its outward movement.

8. Apparatus for drilling between two points a well bore that is inclined from the vertical and has a substantially constantly increasing dip angle using a drill bit at the lower end of a drill string, comprising a bit stabilizer located in the drill string adjacent the drill bit, a string stabilizer located in the drill string a preselected distance above the bit stabilizer, a telescoping joint located in the string between the two stabilizers to allow the length of the drill string between the two stabilizers to increase as the bit continues to drill, and means in the telescoping joint to produce a pressure drop in the drilling mud pumped through the telescoping joint that produces a preselected compressive force in the drill string between the two stabilizers to provide the desired weight on the bit and to cause a preselected bending of the drill string between the stabilizers to cause the bit to tend to increase the dip angle of the well bore as the distance between the stabilizers increases and the bending increases.

9. A method of recovering substances from a subsurface earth formation, comprising: drilling a borehole along a catenary curve into said formation from a location horizontally and vertically displaced from said formation, and withdrawing substances from said formation.

10. A method of drilling a borehole into a subsurface earth formation, comprising: drilling a borehole into said formation from a location horizontally and vertically displaced from said formation and along a path at least a portion of which is defined by the curve of a catenary, and extending said borehole further through said formation along a substantially horizontal path of travel.

11. A well drilling method comprising: drilling a borehole into said formation along a path at least a portion of which is defined by the curve of a catenary, extending said borehole further through said formation along a substantially horizontal path of travel, and generating a driving force for the drill bit in said horizontal path in response to mud pressure.

12. A method of drilling a well into a subsurface earth formation, comprising: drilling at least a portion of a borehole from a location horizontally and vertically displaced from said formation along the curve of a catenary until the bedding plane of the formation is intersected, and extending said borehole from the catenary curve to and along the bedding plane of the formation to a maximum extent within the bedding plane, and withdrawing substances from said formation.

13. A well drilling method, comprising: drilling at least a portion of a borehole along the curve of a catenary until the bedding plane of the formation is intersected, extending said borehole to and along the bedding plane of the formation to a maximum extent within the bedding plane, and generating a driving force for the drill bit in the bedding plane in response to mud pressure.

* * * * *